US006672697B2

(12) United States Patent
Haflinger

(10) Patent No.: US 6,672,697 B2
(45) Date of Patent: Jan. 6, 2004

(54) COMPENSATION METHOD FOR OVERLAPPING PRINT HEADS OF AN INK JET PRINTER

(75) Inventor: James J. Haflinger, San Diego, CA (US)

(73) Assignee: Eastman Kodak Company, Rochester, NY (US)

( * ) Notice: Subject to any disclaimer, the term of this patent is extended or adjusted under 35 U.S.C. 154(b) by 82 days.

(21) Appl. No.: 10/008,790

(22) Filed: Nov. 8, 2001

(65) Prior Publication Data

US 2002/0180816 A1 Dec. 5, 2002

Related U.S. Application Data

(60) Provisional application No. 60/294,880, filed on May 30, 2001.

(51) Int. Cl.[7] ..... B41J 29/38
(52) U.S. Cl. ..... 347/12; 347/9
(58) Field of Search ..... 347/40, 43, 41, 347/9, 12, 16

(56) References Cited

U.S. PATENT DOCUMENTS

| | | | | |
|---|---|---|---|---|
| 4,812,859 A | * | 3/1989 | Chan et al. | 347/43 |
| 5,124,720 A | | 6/1992 | Schantz | 347/19 |
| 5,384,587 A | | 1/1995 | Takagi et al. | 347/41 |
| 5,488,397 A | | 1/1996 | Nguyen et al. | 347/40 |
| 5,541,624 A | | 7/1996 | Cooke et al. | 347/88 |
| 5,581,283 A | | 12/1996 | Rogers | 347/40 |
| 5,610,635 A | | 3/1997 | Murray et al. | 347/7 |
| 5,896,147 A | | 4/1999 | Mori et al. | 347/61 |
| 5,923,349 A | | 7/1999 | Meyer | 347/43 |
| 5,988,801 A | | 11/1999 | Coiner | 347/85 |
| 6,172,700 B1 | | 1/2001 | Obata | 347/237 |
| 6,341,840 B1 | * | 1/2002 | Van Doorn et al. | 347/41 |
| 6,464,331 B1 | * | 10/2002 | Van Doorn et al. | 347/41 |
| 6,582,055 B1 | * | 6/2003 | Biddle et al. | 347/40 |

FOREIGN PATENT DOCUMENTS

EP 1 075 958 A1 2/2001

* cited by examiner

*Primary Examiner*—Thinh Nguyen
(74) *Attorney, Agent, or Firm*—Milton S. Sales; Thomas R. Arno

(57) ABSTRACT

A system and method of ink jet printing in a printer having more than one print head is disclosed. The printing results in improved image quality by dithering the transition from one print head to the next and by individually adjusting the timing of the firing of each of the print heads. This allows the printer to create a better quality image in instances of horizontal or vertical misalignment of the print heads, without the need for costly and problematic mechanical systems.

8 Claims, 10 Drawing Sheets

Vertically Misaligned Print Heads

WORST CASE: Horizontally and Vertically Misaligned Print Heads

Correctly Aligned Print Heads
Improved by Dithering

Dithering to Correct Vertically

Misaligned Print Heads

Dithering Utilized to Improve Horizontally and Vertically Misaligned Print Heads Dithering and Offset Utilized to Improve Horizontally and Vertically Misaligned Print Heads

COMPENSATION METHOD FOR OVERLAPPING PRINT HEADS OF AN INK JET PRINTER

RELATED APPLICATIONS

This application claims priority to U.S. Provisional Application No. 60/294,880, filed May 30, 2001.

BACKGROUND OF THE INVENTION

1. Field of the Invention

The current invention relates generally to the field of ink jet printers and plotters and more specifically to those printers and plotters with multiple print heads.

2. Description of the Related Art

Ink jet printers and plotters fall within a class of non-contact type printing where an image is formed on the surface of the medium by depositing droplets of ink from nozzles onto the print medium. The ink droplets are formed by heating a small portion of ink and selectively expelling it from a nozzle located on the face of a printing element or print head. Each print element or print head will have numerous nozzles from which ink droplets are expelled. A typical print head will have a column of more than 100 nozzles.

The vertical height of a strip of ink droplets a printer deposits in a single pass of the print head over the media is referred to as the swath height of the printer. The time it takes to print a sheet of paper of a fixed dimension will be the number of passes the print head would have to make to cover the vertical length of the paper, which depends on the swath height. Printing processes may also involve several passes over the same swath height for various reasons not directly related to this invention, but the print time for a sheet in these processes will also be dependent upon the swath height.

In some printers, the swath height of one particular color of ink is increased by mounting more than one print head for that color on the printer carriage. By mounting another print head in a manner such that its nozzles are vertically offset from the nozzle locations of the first print head, the swath height of the printer for that color is effectively increased, thereby allowing fewer passes and faster print times for a given size paper. Generally, the two print heads are arranged so that the upper few rows of nozzles on the lower print head overlap the lower few nozzles of the upper print head. The region of swath height that can be covered by nozzles from both of the print heads is referred to as the overlap region of the print heads. An example of an overlap region could be a ten nozzle region of two overlapping print heads each having 100 nozzles so that the effective swath height of the two print heads together would be 190 nozzles.

Due to manufacturing constraints the relative position of the second print head cannot be guaranteed to be exact with respect to the first print head. If the nozzles of the second print head are not exactly aligned with those of the first print head, image quality will be diminished. If the misalignment is significant enough, visible discontinuities may develop. Common discontinuities include banding, which may arise from either vertical or horizontal misalignment, or both. Mechanical devices have been described in the art that can move one or both of the print heads to correctly align them. These systems are problematic and expensive as they require mechanisms for displacing the print heads and control circuitry to run the mechanisms. Also, systems that alter the nozzle firing timing of nozzles have been developed for use with the mechanical systems to correct horizontal misalignment of two print heads.

Additionally, the droplets from the nozzles of each print head tend to be unique to that print head due to a number of variables such as differing specific resistor heating characteristics and nozzle size differences. Because ink droplet deposition is unique to each nozzle set, the change from the droplets deposited by the nozzles on one print head to those of the other print head can also degrade the quality of the resulting image. These problems are compounded where the swath height of a printer is further increased by adding more than two print heads.

SUMMARY OF THE INVENTION

A method and system are described for inkjet printing utilizing a printer having at least two print heads, by dividing an image to be imprinted upon a print medium into a plurality of raster lines with each one of the plurality of raster lines comprising a plurality of pixels. The printer then expels a plurality of ink droplets from the at least two print heads and onto the print medium corresponding to the plurality of pixels such that not all of the plurality of raster lines are formed only by one of the at least two print heads.

In another embodiment a method of depositing an image onto a print medium by a printer having at least a first print head and a second print head is disclosed, the method comprising depositing a plurality of drops of ink from the first and second print heads along a plurality of lines of print onto the print medium such that a number of the plurality of drops of ink comprising at least one of the plurality of lines of print are deposited from both the first print head and the second print head.

Another embodiment disclosed is a method of depositing an image onto a print medium by a printer having at least a first print head and a second print head comprising depositing a plurality of drops of ink from the first and second print heads along a plurality of lines of print onto the print medium such that a number of the plurality of drops of ink comprising at least one of the plurality of lines of print are deposited from both the first print head and the second print head.

In yet another embodiment, the previous embodiments a further developed by controlling a sequence of the expelling of ink droplets form each of the more than one print heads independently such that the sequence of expelling from a one of the at least two print heads may be altered relative to the others of the at least two print heads.

DETAILED DESCRIPTION OF THE PREFERRED EMBODIMENT

Embodiments of the invention will now be described with reference to the accompanying figures, wherein like numerals refer to like elements throughout. The terminology used in the description presented herein is not intended to be interpreted in any limited or restrictive manner simply because it is being utilized in conjunction with a detailed description of certain specific embodiments of the invention. Furthermore, embodiments of the invention may include several novel features, no single one of which is solely responsible for its desirable attributes or which is essential to practicing the inventions herein described.

Figure 1:
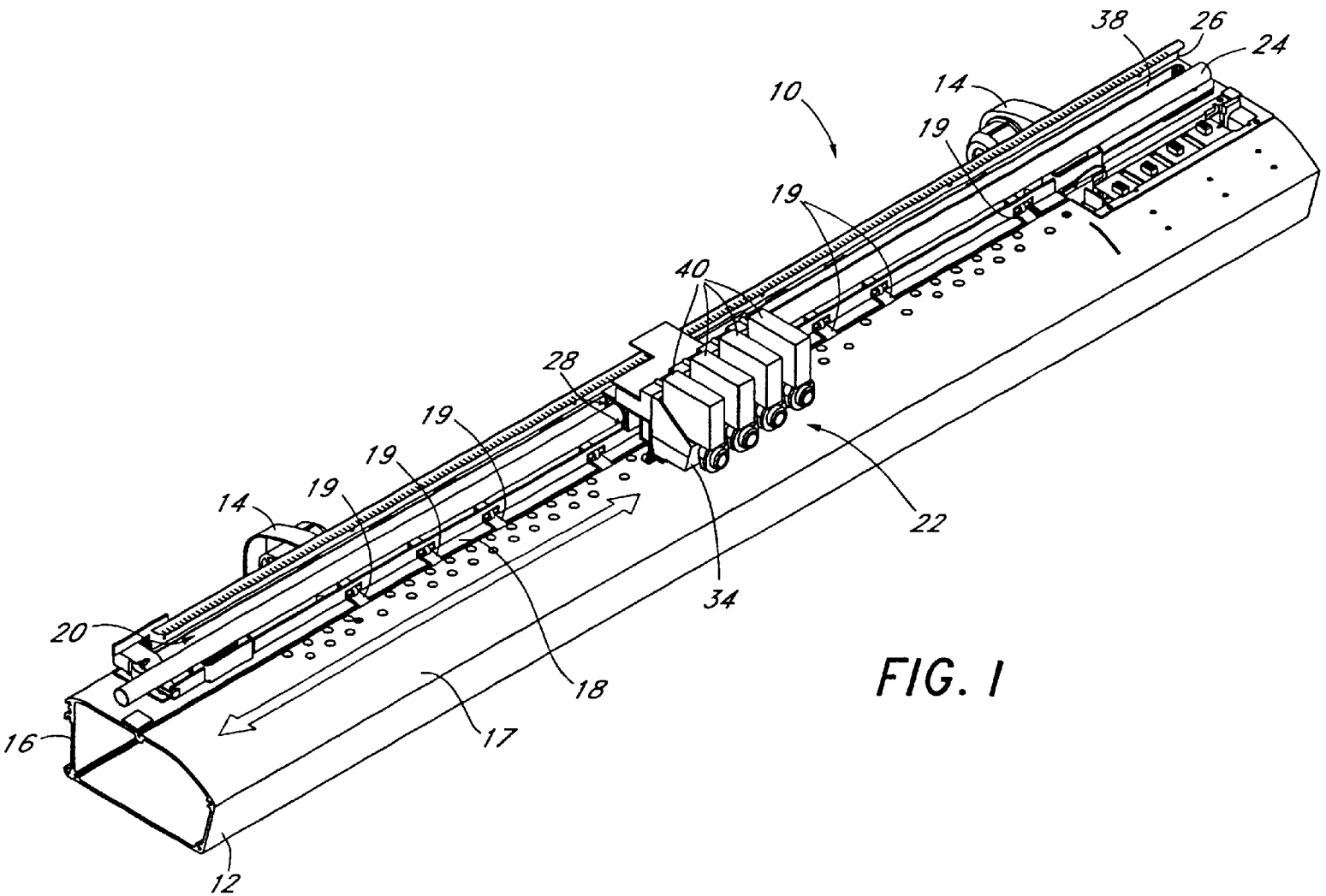
FIG. 1 is a perspective view of one type of an ink jet printer system.

The present invention is advantageously applied to ink jet printers. Accordingly, an overall description of a typical large format ink jet printer is first provided with reference to FIG. 1. Referring now to FIG. 1, a printer carriage assembly 10 is supported on the top face of a printer housing 12, which is a part of a typical printer device. The housing 12 may be supported by a pair of legs or an overall printer housing (not shown) and advantageously encloses various electrical and mechanical components related to the operation of the printer/plotter device.

This exemplary printer may have a pair of roll holders 14 mounted to a rear side 16 of the housing 12 that is slidable to accept media rolls of various widths. The roll may be of continuous print media (not shown in this Figure) mounted on the roll holders 14 to enable a continuous supply of paper to be provided to the printer/plotter carriage assembly 10. Other designs may include individual sheets of media that may be fed into the rear side 16 of the housing as needed; alternatively automatic sheet feeding designs that are common in the art may be used as well. The housing 12 may advantageously have a topside 17, a portion of which advantageously forms a platen 18 upon which the printing/plotting is performed by select deposition of ink droplets onto the print media. The print media is preferably guided from the rear side 16 of the housing 10 under a support structure 20 and across the platen 18 by a drive mechanism, which may be a plurality of drive rollers 19 that are advantageously spaced along the platen 18.

The support structure 20 is preferably mounted to the topside 17 of the housing 12 with sufficient clearance between the platen 18 and the support structure 20 along a central portion of the platen 18 to enable a sheet of print media to pass between the platen 18 and the support structure 20. The support structure 20 advantageously supports a print carriage 22 above the platen 18. The support structure 20 may include a guide rod 24 and a coded strip support member 26 preferably positioned parallel to the longitudinal axis of the housing 12. The height of the carriage 22 above the print media is preferably controlled to a tight tolerance and may be adjustable. Accordingly, inkjet printers have been constructed to allow for manual or automatic adjustment of the carriage 22 height above the platen 18 in order to accommodate different print media thicknesses.

The print carriage 22 includes a plurality of printer cartridge holders 34 each with a printer cartridge 40 mounted therein. The print carriage 22 preferably includes a split sleeve 28, which slidably engages the guide rod 24. This enables motion of the print carriage 22 along the guide rod 24 and defines a linear path, as shown by the bidirectional arrow in FIG. 1, along which the print carriage 22 moves. Advantageously, a motor (not shown) and drive belt mechanism 38 are used to drive the print carriage 22 along the guide rod 24. It should be noted that the terms horizontal and vertical will be utilized in this application to refer to the positions of the print heads with respect to one another; with the horizontal direction being along the length of the guide rod 24 and the vertical direction being along the height of the swath. Each print cartridge 40 preferably is designed to interact with the print carriage 22 to house nozzles that deposit the ink droplets onto the print medium. The correct alignment of the nozzles of one print cartridge 40 with respect to those of the other(s) is desirable for high quality image production.

Figure 2:
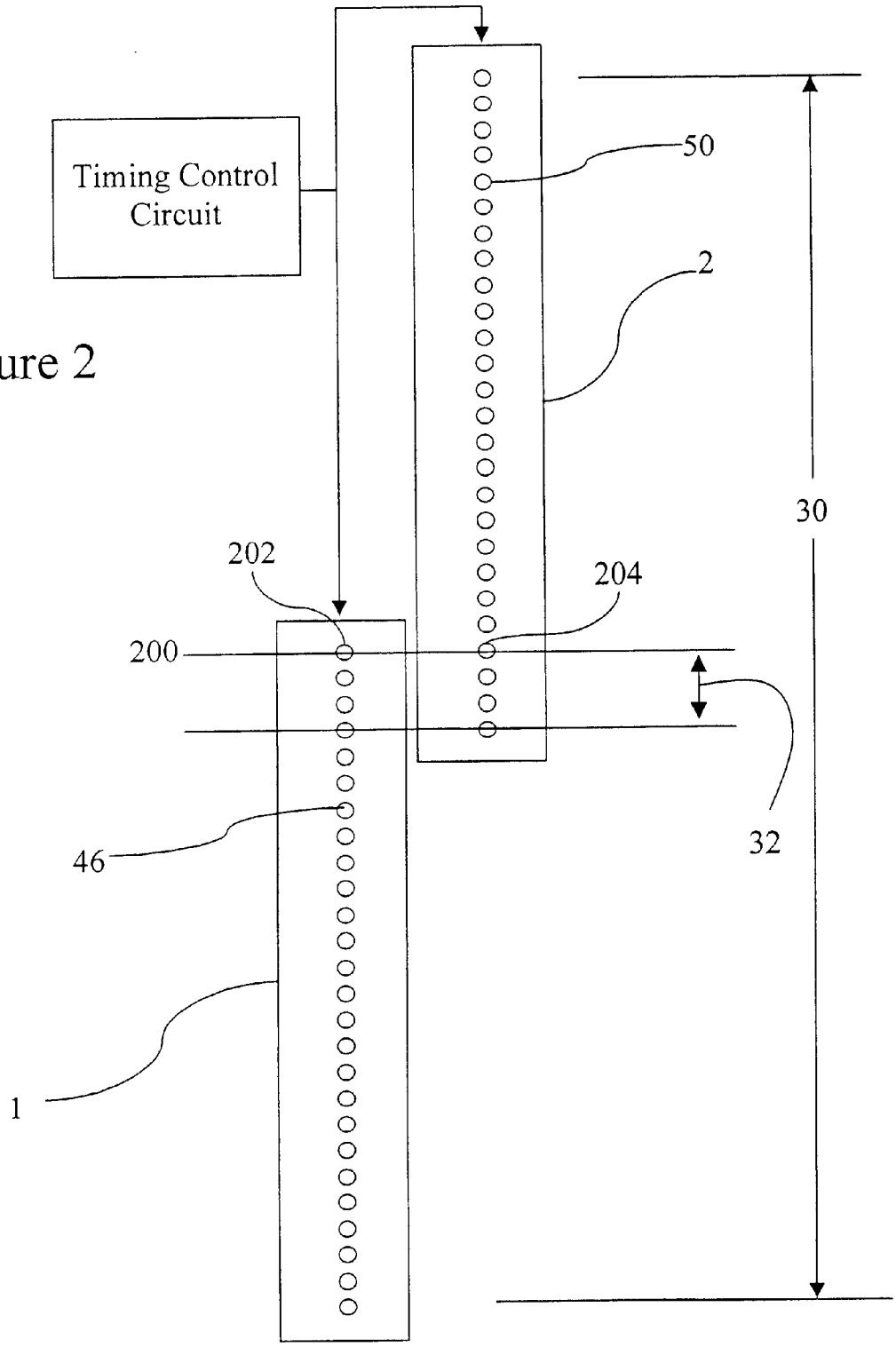
FIG. 2 is a schematic representation of the placement of two print heads with respect to one another.

FIG. 2 illustrates an exemplary positioning of two print heads 1, 2 with respect to one another, utilized to increase swath height. As previously discussed, it is understood by those of skill in the art that more than two print heads 1, 2 may be utilized to increase the swath height and the example of two vertically offset print heads 1, 2 described herein is provided only for illustrative purposes. The print heads 1, 2 in this illustration each contain a column of nozzles 46, 50, through which the ink droplets are expelled and deposited upon the print medium. As is known to those of skill in the art, the ink ejection orifices, or nozzles 46, 50, of many commonly used jet plates, which form part of the print heads 1, 2, may be arranged in two or more horizontally separated vertical columns. Within each column, the position of the nozzles 46, 50 may also be made to vary slightly in the horizontal direction for various reasons that are not pertinent to the present invention. Vertically, however, the nozzles 46, 50 are arranged such that the uppermost nozzle ("nozzle 1") is in one column, and "nozzle 2" is 1/300 of an inch lower (in a 300 dpi printer cartridge) than nozzle 1 and is in another column. In a jet plate utilizing two columns, nozzle 3 is then directly below nozzle 1 in the first column, but is vertically positioned 1/300th of an inch below nozzle 2, i.e. 1/150th of an inch below nozzle 1. The ink ejection nozzles continue in this interleaved fashion down to the last nozzle, which is in the column that has nozzle 2 at the top on jet plates with an even number of nozzles. Nozzles 46, 50 are displaced in this interleaved and columnar fashion for reasons not related to the present invention and it is to be noted that for simplification, all of the nozzles on a jet plate can be considered to fall into one column of nozzles 46, 50 on each jet plate with print head 1, 2 printing successive columns of pixels as it passes over the media.

Multiple nozzles proximate to the upper portion of the lower print head 1 overlap with mutiple nozzles proximate to the lower portion of the upper print head 2; this may be referred to as an overlap region 32. The number of nozzles in the overlap region 32 may vary largely from one design to the next and in the illustration, an example is provided where four nozzles from the lower print head 1 overlap with four nozzles from the upper print head 2. The total effective swath height 30 and the height of the overlap region 32 are illustrated in FIG. 2, and the total effective swath height 30 being achieved by combining the swath height of each of the two offset print heads 1, 2. Again, the total effective swath height 30 is that vertical extent of the media that is covered, or the number of raster lines that may be printed, during each pass of the printer. Therefore, the number of passes required, and necessarily the time required, to produce an image decreases as the total effective swath height 30 is increased. It should be noted that the total effective swath height 30 for the combination of the two print heads 1, 2 is much larger than it would be for either of the two individually. While this illustration shows the use of two print heads to increase the total effective swath height 30, it should be recognized that utilizing more print heads can further increase the total effective swath height 30 and such embodiments can be used. Furthermore, the use of an overlap region 30 of four nozzles 46, 50 from each print head 1, 2 is merely illustrative and it is understood that there is a variety of overlap amounts that can be used.

During printing, as the printer carriage moves across the surface of the print medium, the pixels in those raster lines that lie under overlapping nozzles 46, 50 can be printed on by either a nozzle 46 in the lower print head 1 or a nozzle 50 in the upper print head 2. For example, in FIG. 2 the raster line 200 may have droplets deposited for each pixel by either the appropriate nozzle 202 on the lower print head 1 or the corresponding nozzle 204 on the upper print head 2.

Figure 3:
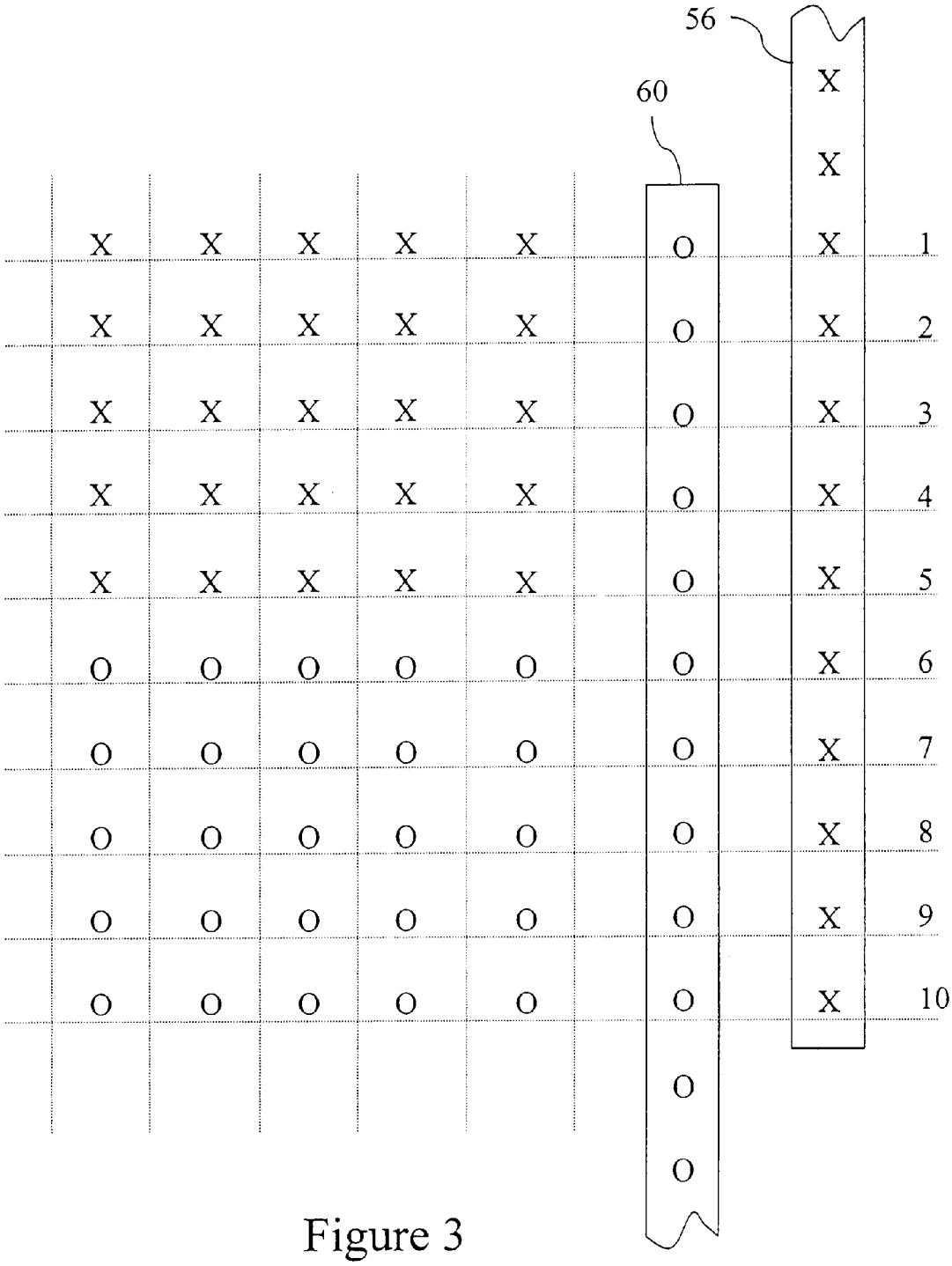
FIG. 3 is an illustration of the ink droplets deposited in a single-pass full color fill by the overlapping region of a printer having two correctly aligned print heads that has printed several columns along the swath direction.

FIG. 3 is an illustration of the ink droplets deposited in a single-pass full color fill by the overlapping region of a printer having two correctly aligned print heads 56, 60 that has printed several columns along the swath direction. In this figure, droplets deposited by the two print heads 56, 60 are distinguished among the two print heads 56, 60 using symbols. The letter "X" indicates droplets deposited by the upper print head 56, and the letter "O" indicates droplets deposited by the lower print head 60. This embodiment illustrates an image deposited by a printer that is configured such that for each raster line only one print head will apply ink droplets, meaning that there is a switch in the overlap region from one print head 56 to the other print head 60 that occurs at a particular nozzle row. Thus, in this illustration, the overlap region is ten rows and the printer has selected the upper print head 56 indicated by X droplets to cover the top five rows, and the lower print head 60 indicated by O droplets to cover the bottom five rows. The transition in the overlap region from one print head 56 to the lower print head 60 occurs from the fifth to the sixth row of nozzles. This is accomplished by disabling the bottom five nozzles of the upper print head 56 and the top 5 nozzles of the lower print head 60. This results in an abrupt transition from the fifth raster line to the sixth raster line where ink deposition in the swath switches from being deposited by the upper print head 56 to being deposited by the lower print head 60.

The image produced by each of the ink droplets deposited by the nozzles can be unique to the print head that produced them. Many factors can influence the extent to which such differences exist from print head to print head. Manufacturing tolerances, inherent resistive heating differences and small differences in pressure supplied to the nozzle may combine with other factors to produce such unique results. Because of this tendency, even the image quality from correctly aligned print heads may suffer degradation in the transition from the nozzles of one print head to those of another.

In this illustration, the print heads 56, 60 are aligned correctly both horizontally and vertically. If the print heads are not aligned correctly, the lowest row of X's may be too close to the upper row of O's, or each column of X's may be vertically misaligned with the corresponding column of O's. In several of the figures that are discussed below, examples of various types of misalignment that may occur in such multiple print head printers are discussed.

Figure 4:
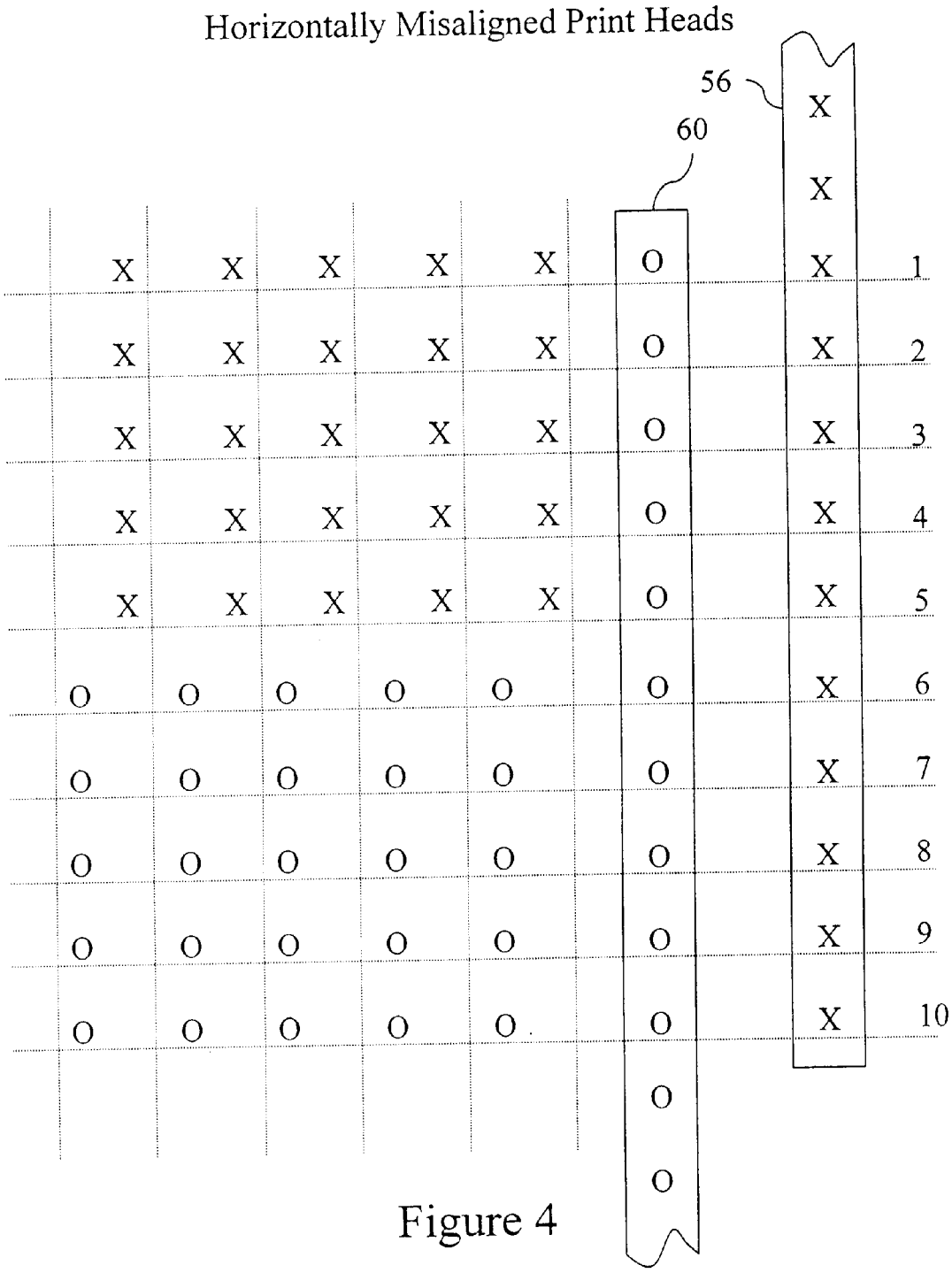
FIG. 4 is an illustration of the ink droplets deposited in a single-pass full color fill by the overlapping region of an ink jet printer having two print heads that are horizontally misaligned.
Figure 5:
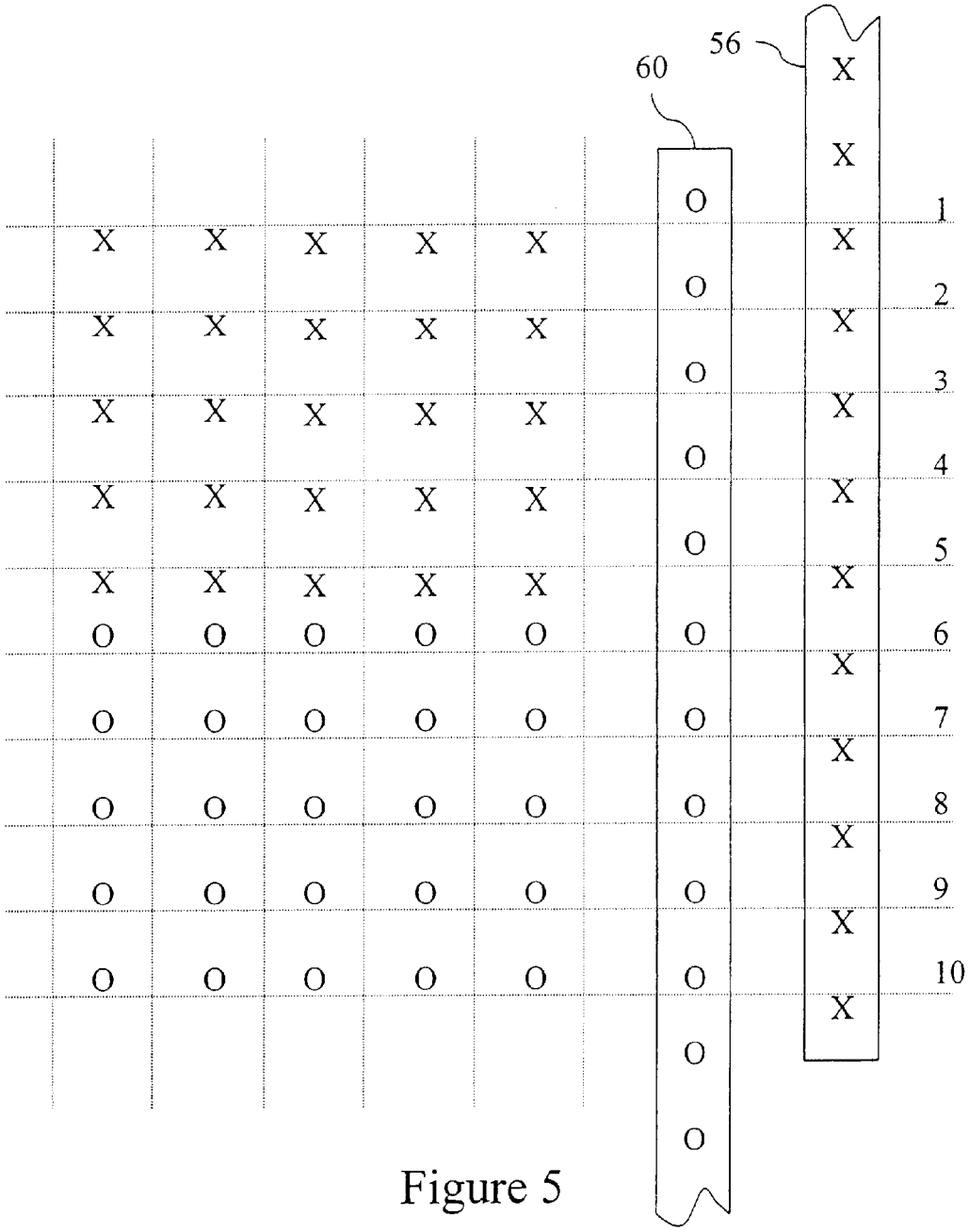
FIG. 5 is an illustration of the ink droplets deposited in a single-pass full color fill by the overlapping region of an ink jet printer having two print heads that are vertically misaligned.

FIG. 4 is an illustration of the ink droplets deposited in a single-pass full color fill by the overlapping region of an ink jet printer having two print heads that are horizontally misaligned. Again, in this figure, droplets deposited by the two print heads 56, 60 are distinguished among the two print heads by using X's for the droplets from the upper print head 56 and O's for the droplets from the lower print head 60. In this illustration indicating that the two print heads 56, 60 are horizontally misaligned, the droplets are disposed in a horizontally offset manner. There may be multiple reasons why horizontal misalignment may occur, which may include mechanical misalignment or an inappropriate firing timing. In any case, when a printer is in such a condition, a discontinuity in the image is created. In FIG. 4, the X's in the top five raster lines are not directly above the corresponding O's in the bottom five raster lines as they are supposed to be FIG. 5 is an illustration of the ink droplets deposited in a single-pass full color fill by the overlapping region of an ink jet printer having two print heads that are vertically misaligned. Again, the droplets deposited are distinguished among the two print heads 56, 60 by using X's for the droplets from one print head 56 and O's for the droplets from the other. In this illustration indicating that the two print heads 56, 60 are vertically misaligned, the droplets are disposed in a vertically offset manner. The vertical distance between the droplets from the top row of active nozzles of the bottom print head 56 and those droplets from the bottom active row of nozzles of the top print head 60 is not the same as the space between any two rows of droplets from the same print head 56, 60. This may be due to a mechanical problem in the positioning of the upper print head 56 with respect to the lower print head 60.

Figure 6:
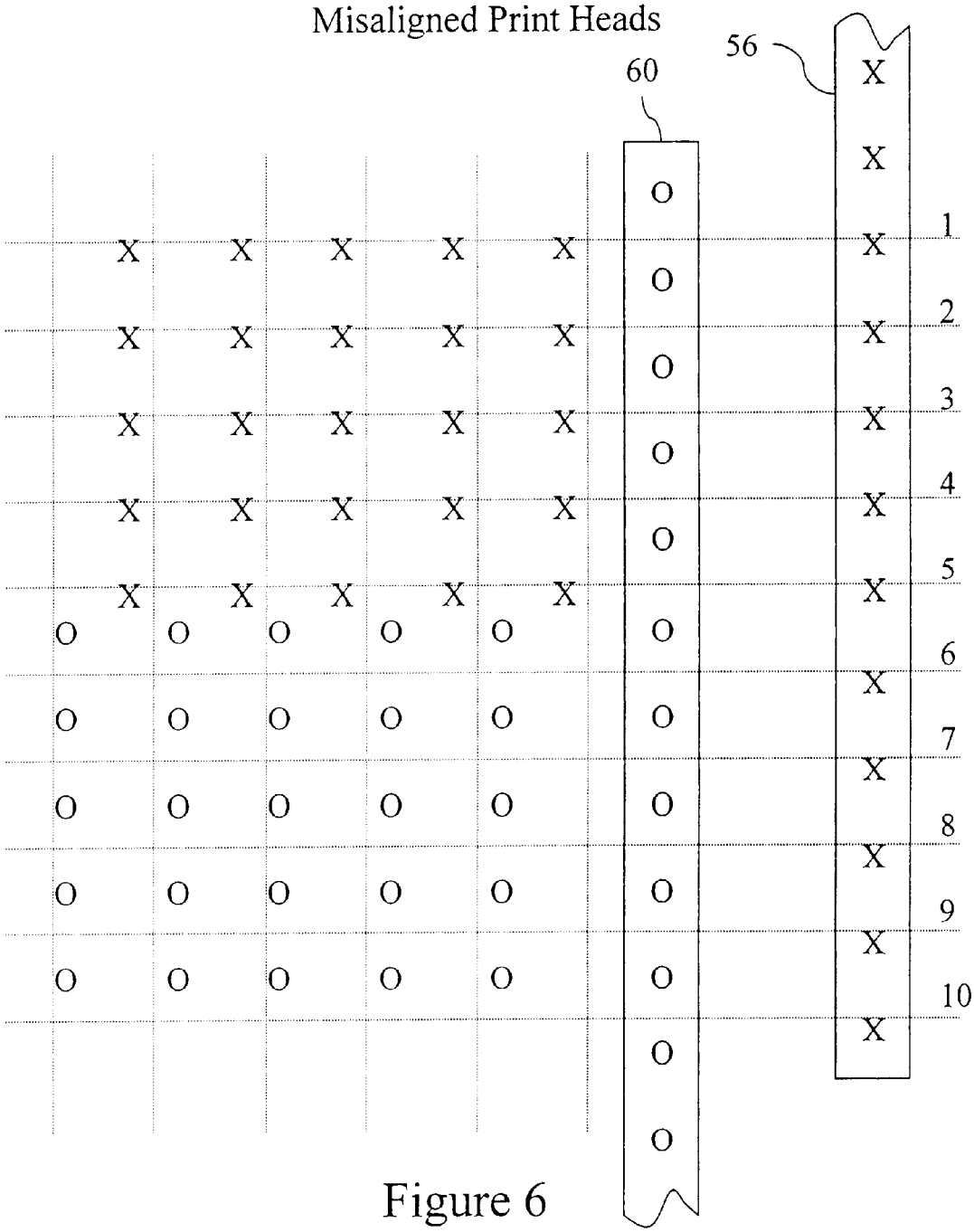
FIG. 6 is an illustration of the ink droplets deposited in a single-pass full color fill by the overlapping region of an ink jet printer having two print heads that are horizontally and vertically misaligned.

FIG. 6 is an illustration of the ink droplets deposited in a single-pass full color fill by the overlapping region of an ink jet printer having two print heads that are horizontally and vertically misaligned. In this illustration, the droplets are disposed in a manner indicating the worst case misalignment scenario; the two print heads 56, 60 are both vertically and horizontally misaligned. This misalignment may produce especially visible horizontal banding at the transition between the fifth and sixth raster lines.

It has been found that the discontinuities discussed above can be significantly reduced by dithering between overlapping nozzles in the raster lines in the overlap region. Dithering may be explained as a method of printing a raster line by assigning some pixels in a raster line to nozzles that are on print head 56, and the rest to a nozzle on the other print head 60. For instance, a particular raster line may have 500 pixels to receive droplets. In a dithering pattern, not all of those droplets will come from a single print head 56, 60; some will come from one print head 56 and the rest will come from the other print head 60.

Figure 7:
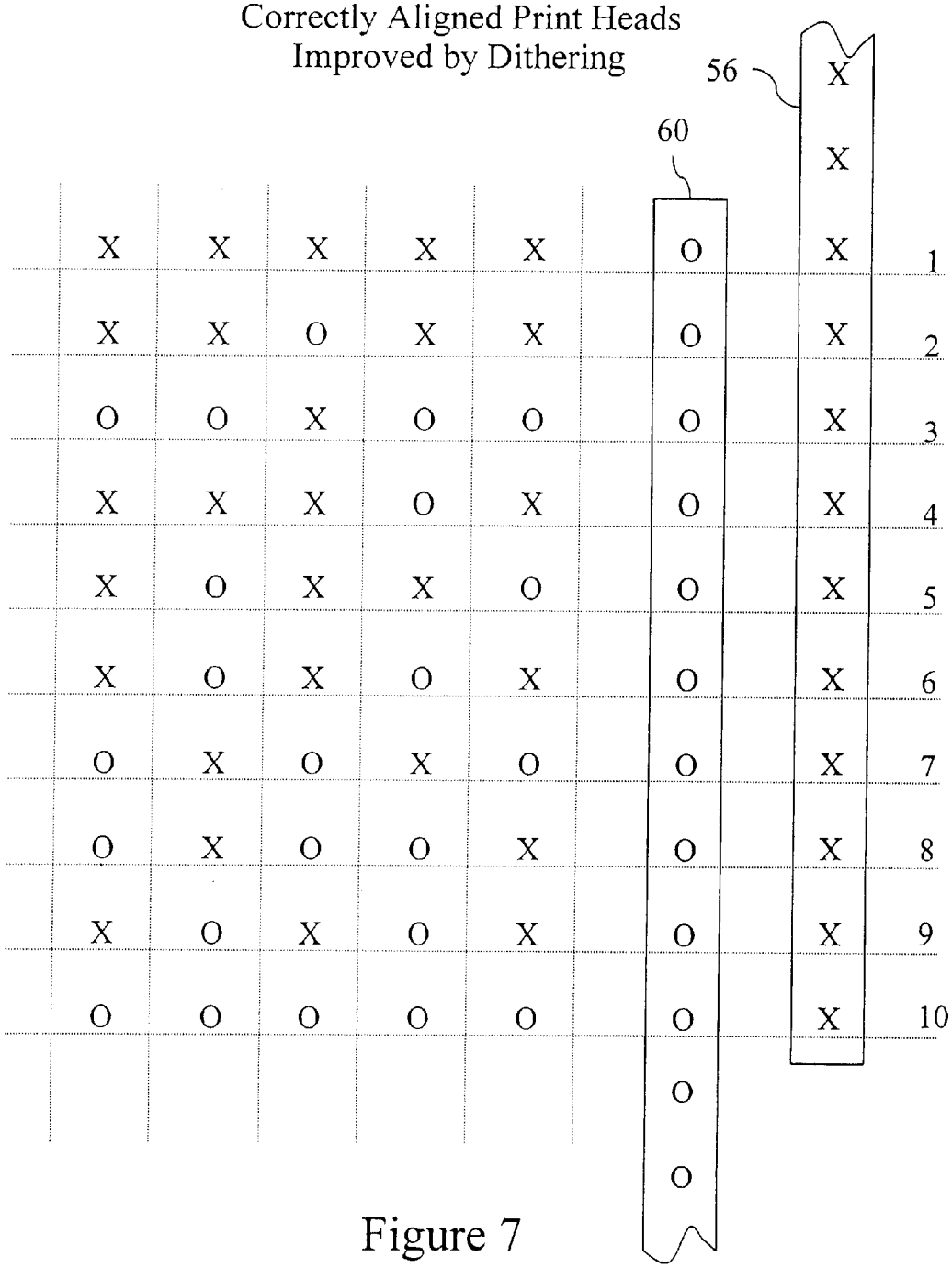
FIG. 7 is an illustration of the ink droplets deposited in a single-pass full color fill by the overlapping region of an ink jet printer having two correctly aligned print heads that uses dithering to improve the print quality.

FIG. 7 is an illustration of the ink droplets deposited in a single-pass full color fill by the overlapping region of an ink jet printer having two correctly aligned print heads that uses dithering to improve the print quality. Again, the droplets in FIG. 7 are distinguished among the upper and lower print heads 56, 60 by X's and O's, respectively. FIG. 7 illustrates a method of improving print quality in such a circumstance, this method being dithering some or all of the raster lines in the overlap region to transition from one print head 56 to the next. In the embodiment illustrated in FIG. 7, the pixels of the first raster line are all vocered with droplets from the upper print head 56 while the pixels of the tenth raster line are all covered by droplets from the lower print head 60. The pixels of the eight other raster lines in the overlap region are covered by using a dithered pattern. For each of these eight raster lines, some of their pixels are covered by droplets from the upper print head 56 and the rest of their pixels are covered by droplets from the lower print head 60. By this method, the abrupt transition from one print head at one raster line to the other print head at the adjacent raster line is avoided.

The dithering pattern utilized in FIG. 7 is merely exemplary and it is understood that there are numerous combinations of patterns that may be utilized. For example, in an overlapping region of four rows, the lowest row may comprise all droplets from the lower print head 60; the second row from the bottom may comprise twenty five percent of the pixels from the upper print head 56 and the rest from the lower print head 60; the third row from the bottom may comprise twenty five percent of the pixels from the lower print head 60 and the rest from the upper print head 56; and the top overlapping row may comprise all of the pixels from the upper print head 56. From this one example, it is clear that a wide variety of dithering patterns are possible. Some advantageous embodiments have an approximately equal distribution in the middle, smoothly transitioning to one print head 56, 60 or the other towards the edges of the overlap region. Instead of the stark transition from one print head to the next as illustrated in FIGS. 4, 5, and 6, dithering between print heads in the overlap region allows for a gradual change and spreads the effects of any existing misalignment or discontinuities between the print heads 56, 60 thereby improving print image quality without expensive and problematic mechanical alignment schemes.

Figure 8:
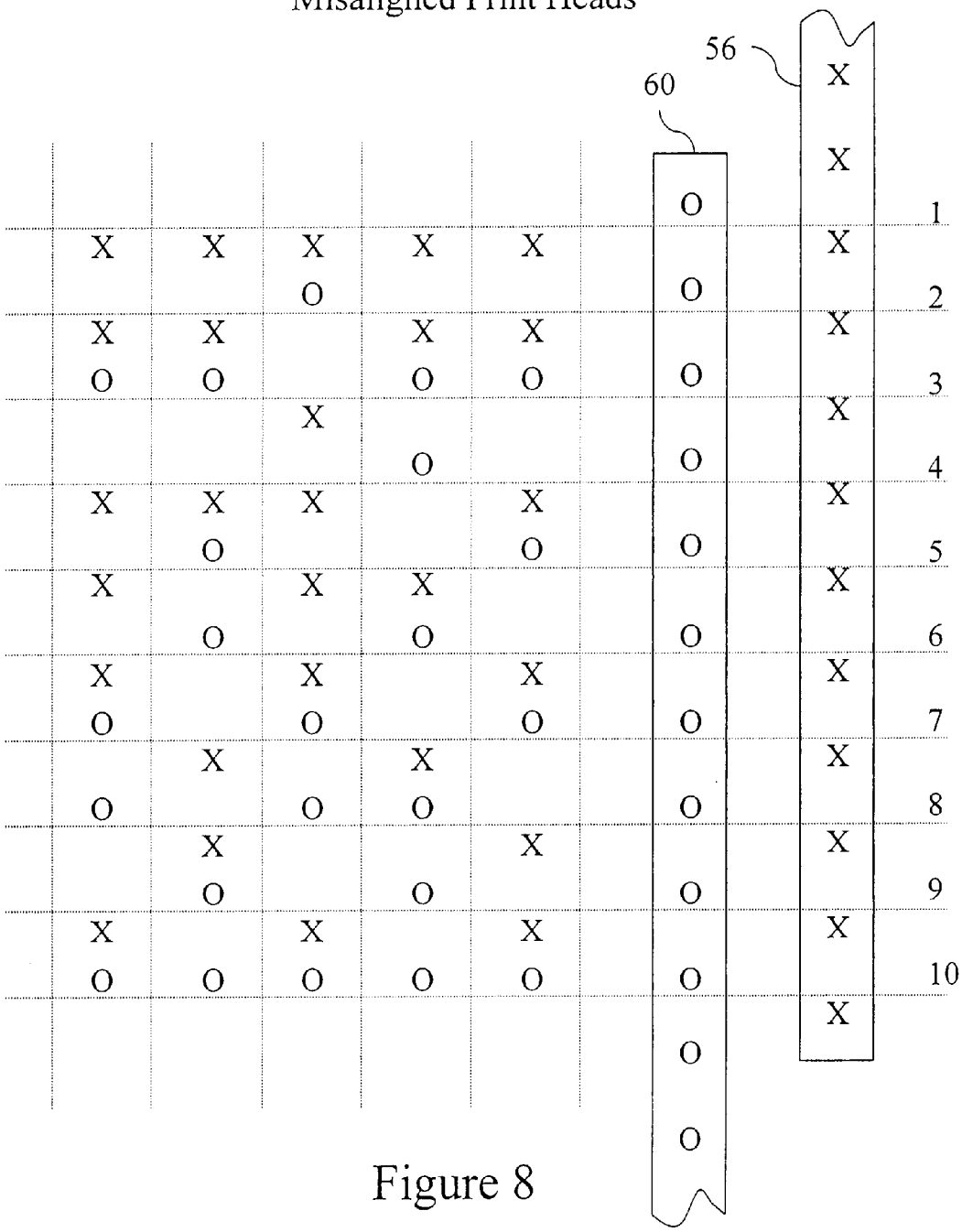
FIG. 8 is an illustration of the ink droplets deposited in a single-pass full color fill by the overlapping region of an ink jet printer having two print heads that are vertically misaligned utilizing dithering to improve the image quality.

FIG. 8 is an illustration of the ink droplets deposited in a single-pass full color fill by the overlapping region of an ink jet printer having two print heads that are vertically misaligned utilizing dithering to improve the image quality. The exemplary dithering pattern is utilized in this embodiment to obscure the vertical misalignment of the two print heads 56, 60 thereby improving the overall image quality. Again, the exemplary dithering pattern of FIG. 8 is used for illustrative purposes only and many different patterns may advantageously be utilized.

Figure 9:
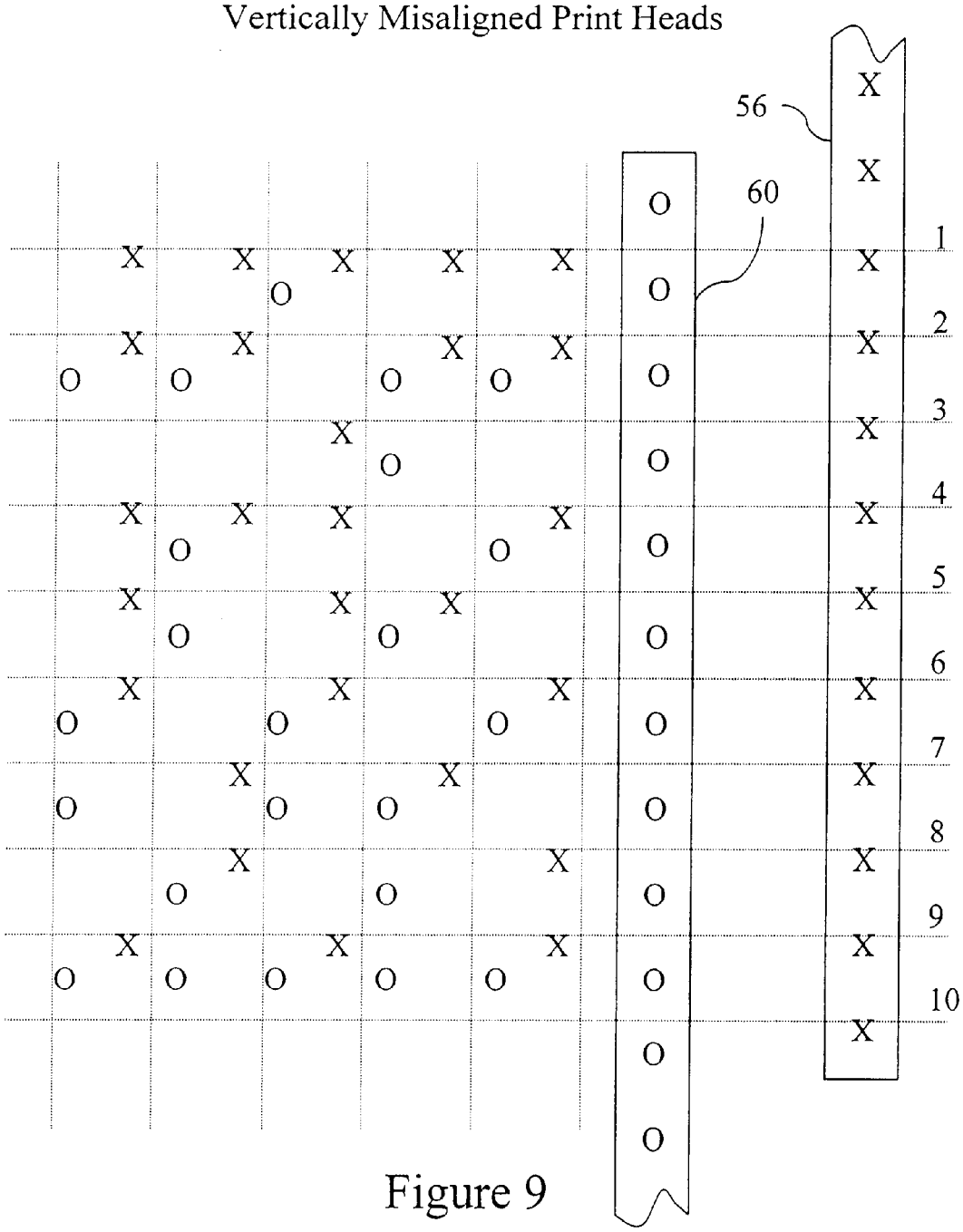
FIG. 9 is an illustration of the ink droplets deposited in a single-pass full color fill by the overlapping region of an ink jet printer having two print heads that are horizontally and vertically misaligned, and where dithering is used to improve the image quality.

FIG. 9 is an illustration of the image pattern produced by the overlapping region of an ink jet printer having two print heads 56, 60 that are horizontally and vertically misaligned, and where dithering is used to improve the image quality. In this figure, the worst case scenario illustrated above by FIG. 5 is improved by the utilization of dithering to mask the effects of the compound misalignment. Through the use of dithering, the banding provided by compound misalignment is replaced with dispersed and, thus, less apparent inaccuracies. Again, the image quality following such dithering may be suitable for many applications and is a substantial improvement over the image produced by the compound misalignment without dithering that is illustrated in FIG. 5.

Figure 10:
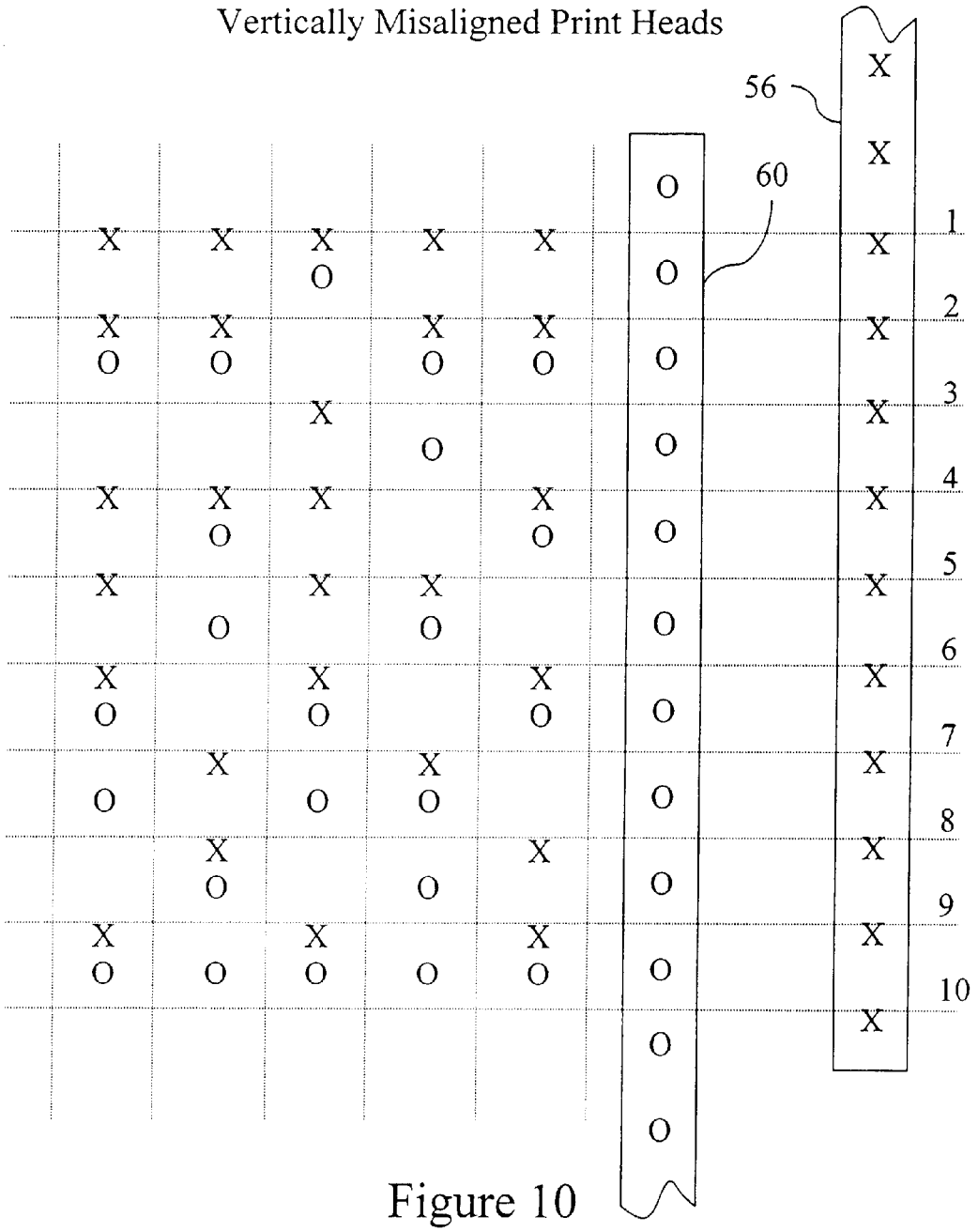
FIG. 10 is an illustration of the ink droplets deposited in a single-pass full color fill by the overlapping region of an ink jet printer employing an example of dithering and timing offset to correct horizontal and vertical misalignment.

FIG. 10 is an illustration of the ink droplets deposited in a single-pass full color fill by the overlapping region of an ink jet printer employing an example of dithering and timing offset to correct horizontal and vertical misalignment. In FIG. 10, the use of dithering, described above and illustrated in FIG. 7 is further improved by including a timing correction, otherwise referred to as offset, to improve the horizontal misalignment. The image quality of FIG. 10 is a vast improvement over the worst case misalignment described above and illustrated in FIG. 7. To correct the misalignment problem, the timing of the firing of the droplets from each print head may be altered. For instance, it may be desirable to delay the firing of the nozzles of the leading print head 56 a short amount of time so that the droplets deposited from that print head 56, indicated by X's, correctly align with those of the trailing print head 60, indicated by O's. This correction may be referred to as offset and preferably takes place in the firing control circuitry of the printer. Advantageously, a printer may be designed wherein the firing of each print nozzle is controlled by an independent signal from the control circuitry so that each of them may be controlled separately. Such independent control would allow for offset correction to correct, theoretically, any horizontal misalignment of the multiple print heads.

The process utilized to correctly align the multiple print heads can take several forms. First, the printer can create a number of test patterns which might be vertical lines drawn by the print heads using different timing signals and the operator could indicate to the printer which timing signal is most appropriate by indicating which pattern looks the best to the user. Alternatively, the printer may be equipped with a light source and a linear CCD array, or some other linear photosensor, such that it could automatically sense the misalignment of corresponding droplets from the print heads and thereby calculate the offset period necessary to adequately compensate for the misalignment. U.S. Pat. No. 5,297,017 to Hasselby and entitled "PRINT CARTRIDGE ALIGNMENT IN PAPER AXIS," which is hereby incorporated by reference for all that it teaches, provides a discussion of such an offset system. Advantageously, the method utilized resolves the offset in increments smaller than the printer resolution. By individually controlling the firing of the two print heads, any horizontal misalignment of the heads can be corrected and the image illustrated in FIG. 3, having proper horizontal alignment, can then be generated.

Through avoidance of complicated mechanical systems and control circuitry typical in systems that reposition one or more of the print heads, image quality is greatly improved for applications that cannot make economical use of such complex systems. Advantageously, the dithering and offset corrections described herein merely require an alteration to print control circuits as they currently exist. Through the adaptation and utilization of currently existing control functions, the image quality of an ink jet printer can be substantially increased with relatively minor changes and without added expense.

The foregoing description details certain embodiments of the invention. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that

What is claimed is:

1. A method of by a printer having at least first and second print heads of the same color, the method comprising the steps of:

passing a first nozzle on said first print head and a second nozzle on said second print head over a raster line;

expelling a plurality of ink droplets from said first nozzle on said first print head and said second nozzle on said second print head such that said raster line is partially printed by said first nozzle and partially printed by said second nozzle; and controlling timing of the expelling of ink droplets from each of the print heads independently such that the timing of expelling from the first print head may be altered relative to the second print head.

2. A method of depositing an image onto a print medium by a printer having at least a first print head and a second print head containing the same color, said method comprising:

depositing a plurality of drops of ink from the first and second print heads along a plurality of lines of print onto the print medium such that a number of the plurality of drops of ink comprising at least one of the plurality of lines of print are deposited from both the first print head and the second print head; and controlling the timing of the deposition of ink droplets form the at least first print head and second print head independently such that the timing of deposition from the first print head may be altered relative to the timing of deposition from the second print head.

3. In an ink jet printer having at least two common color print heads with overlapping segments, a method of improving print quality, the method comprising dithering between nozzles in the overlapping segments such that at least one raster line has some ink droplets deposited by a first one of said at least two print heads and some ink droplets deposited by a second one of said at least two print heads.

4. A method of improving print quality in an ink jet printer having at least first and second common color print heads positioned so as to define a first region of nozzles on each print head that does not overlap with the other print head and a second region of nozzles on each print head that overlaps with a region of nozzles of the other print head, said method comprising allocating ink deposition between the second region of nozzles on said first and second print heads so as to form a smooth transition between depositing all ink with said first print head and depositing all ink with said second print head.

5. An inkjet printer comprising:

a print carriage;

at least two common color print heads each having a plurality of nozzles that deposit discrete ink droplets onto the print medium to form multiple printed raster lines, the plurality of nozzles being generally disposed of on the print heads in columns that are perpendicular to the multiple printed raster lines;

wherein the at least two print heads are located on the print carriage such that at least one of the plurality of nozzles on one of the at least two print heads is positioned to deposit ink onto the same one of the multiple print lines as one of the plurality of nozzles on another of the at least two print heads;

wherein at least one of the multiple printed raster lines is formed by ink droplets deposited by more than one of the at least two print heads; and means for individually timing the deposition of each of the discrete ink droplets, wherein the timing may be altered as necessary to correctly deposit the discrete ink droplets onto the print medium.

6. An inkjet printer comprising:

a print carriage;

at least two common color print heads each having a plurality of nozzles that deposit discrete ink droplets onto the print medium to form multiple printed raster lines, the plurality of nozzles being generally disposed of on the print heads in columns that are perpendicular to the multiple printed raster lines;

wherein the at least two print heads are located on the print carriage such that at least one of the plurality of nozzles on one of the at least two print heads is positioned to deposit ink onto the same one of the multiple print lines as one of the plurality of nozzles on another of the at least two print heads;

wherein at least one of the multiple printed raster lines is formed by ink droplets deposited by more than one of the at least two print heads; and means for allowing a user to select the best timing of deposition by the at least two print heads.

7. An inkjet printer having at least first and second common color print heads with corresponding first and second overlapping segments, comprising:

means for printing a first subset of pixels of a raster line with a nozzle in said first overlapping segment;

means for printing a second subset of pixels of said raster line with a nozzle in said second overlapping segment; and means for automatically adjusting the timing of the deposition of the discrete ink droplets.

8. The inkjet printer of claim 7, wherein the means for automatically adjusting the timing of the deposition of the discrete ink droplets includes a CCD array and a timing control circuit.

* * * * *

UNITED STATES PATENT AND TRADEMARK OFFICE

CERTIFICATE OF CORRECTION

PATENT NO. : 6,672,697 B2
DATED : January 6, 2004
INVENTOR(S) : James J. Haflinger It is certified that error appears in the above-identified patent and that said Letters Patent is hereby corrected as shown below:

Column 8,
Line 65, after "A method of" insert -- inkjet printing --

Signed and Sealed this

Twenty-second Day of March, 2005

JON W. DUDAS
*Director of the United States Patent and Trademark Office*